United States Patent [19]

Briolle et al.

[11] Patent Number: 4,607,825

[45] Date of Patent: Aug. 26, 1986

[54] LADLE FOR THE CHLORINATION OF ALUMINIUM ALLOYS, FOR REMOVING MAGNESIUM

[75] Inventors: Emile Briolle, Saint-Egreve; Jean-Marie Hicter, Voiron; Adolfo Mateos, Grenoble, all of France

[73] Assignee: Aluminum Pechiney, France

[21] Appl. No.: 752,892

[22] Filed: Jul. 8, 1985

[30] Foreign Application Priority Data

Jul. 27, 1984 [FR] France ..... 84 12270

[51] Int. Cl.[4] ..... C22B 21/06; F27D 7/02

[52] U.S. Cl. ..... 266/215; 266/217; 266/225; 266/235; 75/68 R

[58] Field of Search ..... 266/215, 217, 225, 235; 75/68 R, 93 E

[56] References Cited

U.S. PATENT DOCUMENTS 4,052,199 10/1977 Mangalick ..... 75/93 E 4,426,068 1/1984 Gimond et al. ..... 266/217

*Primary Examiner*—Melvyn J. Andrews

*Attorney, Agent, or Firm*—McDougall, Hersh & Scott

[57] ABSTRACT

The present invention relates to a ladle for the chlorination in co-flow mode of aluminium alloys in a molten state.

It is divided by a vertical partition (6) which, with the bottom, leaves a space (7) for the flow of the metal, into a feed compartment (8) and a treatment compartment (9) in which a chlorinated gas distributor rotor (10) is immersed. It is characterized in that the treatment compartment is closed at its base by a horizontal wall (13) which extends at the level of the bottom of the partition and which is apertured at its center by an opening whose axis coincides with the axis of rotation of the rotor.

It is used in the removal of magnesium from aluminium alloys and, with ladles of a capacity of close to 1 $m^3$ and which can therefore be easily maneuvered, it makes it possible to attain treatment capacities of the order of 20 T/hour with suitable levels of efficiency in regard to the removal of magnesium.

7 Claims, 2 Drawing Figures

LADLE FOR THE CHLORINATION OF ALUMINIUM ALLOYS, FOR REMOVING MAGNESIUM

Figure 1:
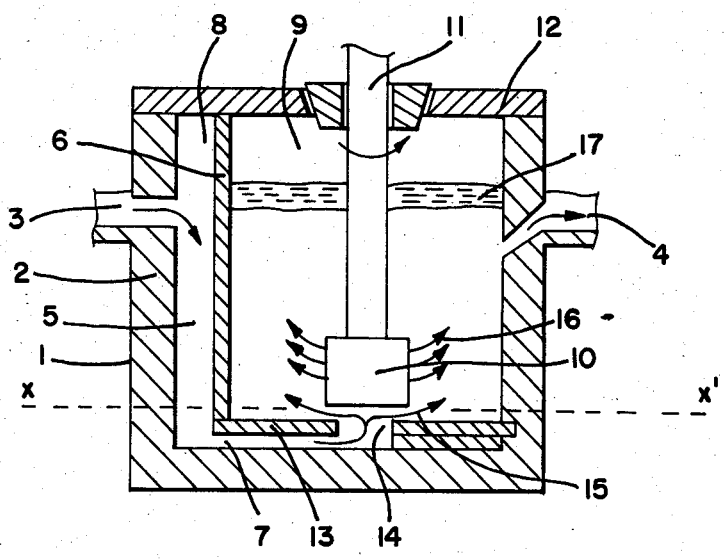

The present invention relates to a ladle for removing the magnesium contained in aluminium alloys, using the "chlorination" process, that is to say, by treating the metal in a molten condition with gaseous chlorine or any other gaseous compound of chlorine, including chlorinated hydrocarbons.

The production by casting of semifinished products of aluminium or aluminium alloy such as plates, billets, etc. involves using either "primary" aluminium which results directly from the electrolysis of a bath of alumina and cryolite, or "secondary" aluminium which is produced by re-melting scrap, or also a mixture of the two types of metal.

In the last two cases, the metal contains in particular magnesium as an impurity, and the proportion thereof may reach several percent by weight in regard to secondary aluminium, while the presence thereof is generally harmful to suitably carrying out the subsequent stages in transforming the metal.

It is for that reason that it is necessary, before the casting process, to carry out an operation which is referred to as a refining operation, in order to remove that impurity down to a relatively low level, which for certain uses is not to exceed a few hundreds of ppm.

The present processes for removing magnesium, which are referred to as "demagging" processes, can be divided into three categories:

electrochemical processes such as those referred to as three-layer electrolysis, wherein a direct electrical current is passed through the metal to be purified, in the molten state, to permit the magnesium to be separated off at the cathode;

processes using solid fluxes based on $AlCl_3$, $AlF_3$ and other salts, which are mixed with the liquid aluminium to be purified so as to form with the magnesium either chlorides or fluorides and which, because of their relatively low specific weight, rise to the surface of the bath where they are separated from the aluminium; and chlorination processes which comprise bubbling gaseous chlorine into the aluminium bath to be purified, where it will preferably react with the magnesium to give a liquid chloride which will also be separated off at the surface of the bath.

Each of those types of processes has advantages and disadvantages, but it is the third process which is the most widely used in industry at the present time although it gives rise to a number of problems in regard to fume and smoke emission and the formation of substantial amounts of aluminium chloride, and is of a reduced level of efficiency when the amount of magnesium in the metal to be treated is relatively low.

In principle, the chlorination process is based on the fact that, thermodynamically, magnesium has greater affinity for chlorine than aluminium so that preferentially that gives the following reaction;

$$Mg + Cl_2 \rightarrow MgCl_2$$

and the aluminium chloride which is partly formed itself contributes to the "demagging" action, by virtue of the following reaction:

$$\tfrac{2}{3}AlCl_3 + Mg \rightarrow \tfrac{2}{3}Al + MgCl_2$$

However, because of the relatively substantial mass of Al, relative to the magnesium, not all the mass of $AlCl_3$ which is formed is used in the second reaction, and that is particularly the case in direct proportion to a falling level of concentration of Mg, so that, as stated on page 55 of the Journal of Metals dated July 1982, it is necessary to use up to 15 kg of chlorine to remove 1 kg of magnesium, whereas theoretically the amount involved is 2.95 kg.

Hence the efforts on the part of the man skilled in the art in seeking to improve the levels of efficiency in regard to use of chlorine, in particular by designing processing apparatuses which are better suited to the above-indicated reactions.

Thus, French Pat. No. 2 200 364 teaches a reactor which is divided into a plurality of chambers, each of which is equipped with a rotary chlorine injector and in which chlorination of the magnesium, as it occurs, on a progressive basis, makes it possible to achieve amounts of chlorine which are close to 3 kg per kg of magnesium. However, as stated in an article taken from Light Metals 1978 of the Metallurgical Society of A.I.M.E., such a reactor may comprise three chambers, each of which is 760 to 1200 mm in length and 600 mm in width. In a foundry, that therefore results in an installation which occupies a relatively substantial area on the ground and which is consequently difficult to manoeuvre when carrying out emptying, cleaning or other operations. That results in relatively high maintenance costs, without considering the initial capital investment costs which are equally substantial.

It is for that reason that the applicants, while retaining the principle of removing magnesium by the flow of a chlorinated gas emitted by a rotor, sought in their invention to provide an apparatus which avoids the disadvantages of the sheer size and fixed nature of the prior-art apparatuses, that is to say, to develop a ladle of relatively small volume but which nonetheless has a treatment capacity that is greater than the competing ladles.

It was after many pilot tests that the applicants arrived at the conclusion that, to solve their problem, the only way was to have recourse to treating the metal by means of the gas by causing the two fluids to flow in the same direction and in the most rational fashion possible. For that purpose, the applicants designed an industrial co-flow ladle formed in conventional manner by an external metal casing, an internal refractory lining, a metal inlet spout or passage and a metal outlet spout or passage, a vertical internal partition which, with the bottom of the ladle, leaves a space for the circulation of the metal and which divides the ladle into a feed compartment and a single treatment compartment in which a rotor producing radial dispersion of chlorinated gas is immersed, but characterised in that the treatment compartment is closed at its base by a horizontal wall which extends at the level of the bottom of the partition and which is apertured at its centre with an opening, the axis of which coincides with the axis of rotation of the rotor.

The invention therefore comprises incorporating into a conventional ladle a complementary horizontal wall which further isolates the treatment compartment from the feed compartment and which, by means of an opening which is suitably positioned on the axis of the chlorinated gas distributor rotor, permits the metal to be channelled in a particular direction which is in the same sense as the trajectory of the gases emitted radially by the rotor and substantially parallel to that trajectory. Such a ladle approaches the ideal conditions for a co-flow circulatory pattern.

It is true to say that co-flow circulation in itself has been used in the prior art. Thus, it can be seen from French Pat. No. 2 200 364 that the metal and the gas flow in the same direction in the second processing or treatment chamber. However, that is rather a question of convenience for the purpose of causing the metal to go from one chamber to the other, rather than a deliberate intention to use the co-flow circulatory mode. In support of that assertion, it may be noted that the patent makes no mention of a higher degree of efficiency in regard to treatment at the level of the second chamber. Accordingly, that type of circulation is produced without any particular precaution being taken, and rather it occurs incorrectly since the metal passes into the chamber by flowing parallel to the bottom of the reactor.

The results obtained by the applicants, by effectively reproducing the conditions of a co-flow circulatory mode, show that that type of circulation is essential in order to achieve an improved magnesium removal effect.

In fact, having used two treatment ladles, each having a capacity of 1 $m^3$ of liquid metal approximately and into which is passed the same alloy in a molten condition, containing 0.5% Mg, at a flow rate of 10 T/hour, using the same type of rotor with the same chlorinated gas flow rate and operating one ladle in a counter-flow mode and the other ladle in a co-flow mode in accordance with the means of the present invention, the applicants found that the levels of efficiency in regard to utilisation of chlorine in dependence on the final magnesium content were as follows for each type of circulation:

| Final content of Mg (% by weight) | | 0.05 | 0.10 | 0.15 | 0.18 | 0.20 |
|---|---|---|---|---|---|---|
| Chlorine utilisation efficiency | Counter-flow circulation | 45 | 80 | 98 | 100 | 100 |
| | Co-flow circulation | 60 | 90 | 99 | 100 | 100 |

It should be noted that if, for relatively substantial final proportions of magnesium, the type of circulation is not a matter of major importance, in contrast, for lower proportions of magnesium, the co-flow type of circulation provides a substantial improvement, for ladles of smaller dimensions than those used in the prior art and in which the metal flow rate is relatively more substantial.

The horizontal wall of the treatment compartment of the ladle according to the invention is preferably provided with a circular opening although any other section of similar contour to that of the horizontal section of the compartment may be used. What is important is to have a certain similarity to permit the trajectories of metal and gas to have a regular geometrical distribution with respect to the axis of the rotor, and to best provide the conditions for a co-flow circulatory mode. The section of the opening is preferably between 1/10 and 1/15 of the section of the treatment compartment, being ratios which have given the best results.

From the point of view of conducting the metal to the opening, in order to provide for a regular feed and to avoid disturbances in the flow pattern which would be harmful to achieving a correct co-flow circulatory configuration, it is also preferable for preferably the bottom of the ladle to be provided with a liquid flow duct which initially, at the level of the partition, is of a width in a horizontal plane, which is close to that of the ladle, and which then progressively decreases so that, close to the opening, it reaches a width corresponding to the largest dimension of the opening.

As regards the radial-distribution rotor, the lower face thereof is positioned as closely as possible to the opening, while leaving a space which is at least 0.02 m in height. The rotor has a horizontal section whose dimensions are close to those of the opening.

The rotor may be a rotor of any radial gas distribution type such as for example the rotor disclosed in French Pat. No. 2 512 067 which may be used with or without the liquid flow ducts. It must simply comprise a sufficient number of gas ducts to ensure a flow rate of up to 240 kg/hour of chlorinated gas thereby to permit treatment capacities of several tonnes per hour, even with alloys which are particularly highly charged with magnesium. The chlorinated gas may be elementary chlorine or any other chlorinated derivative which is generally used in the chlorination of aluminium.

Being compact and of small dimensions, the chlorination ladle according to the present invention may be of the type which is the subject-matter of French Pat. No. 2 514 370 and may therefore make it possible to provide for the removal of magnesium, while enjoying the benefit of all the advantages thereof, namely:

Total emptying of the metal contained in the ladle by simple pivotal movement at the end of the casting operation and therefore without any loss of metal and without the slightest risk of mixing with the metal in the following operation, Instantaneous change of metal or alloy without any manoeuvre other than the pivotal movement, which makes it possible to operate with continuous or discontinuous casting processes, even with successive alloys which are incompatible with each other, Ease of removing dross or scum in the course of treatment by way of the removable part of the cover, which is particularly useful in regard to long-duration continuous casting operations, Ease of cleaning out the empty ladle at the end of a treatment by longitudinal pivotal movement (or lateral pivotal movement, according to circumstances), which makes it possible to remove any residues of dross or scum and solidified metal which would give rise to the danger of polluting the following charge, Independent ladle heating system, which permits exchange or repair without interfering with the operations which are being carried out, The possibility of rapidly heating up the metal when starting up the casting operation, No limitation in regard to the choice of the type of treatment agent injector: any rotary types which are known at the present time can be adapted without any difficulty, Rapid permutation of the injector and the heating system, which permits the desired function to be used at the desired time, Speed of removing and refitting the cover, whether for visual inspection, removal of dross or scum, or recovery of the magnesium chloride formed, Little danger of corrosion by air and the treatment agents because of the simple design and the choice of materials used, and The gaseous effluents are easy to collect.

It is possible to associate therewith other advantages such as the possibilities of integral automation of all the operating movements for pivoting, lifting and fitting the cover, removing, changing and fitting the heating system and the injector, preheating, holding the ladle at a given temperature, etc., which operating procedures may be programmed, with the different safety measures and prohibitions required, and centralised on a remote console which also provides pilot control for the central hydraulic station for actuating the various jacks for pivotal movement and upward-downward movement of the cover, the heating system and the injector.

Figure 2:
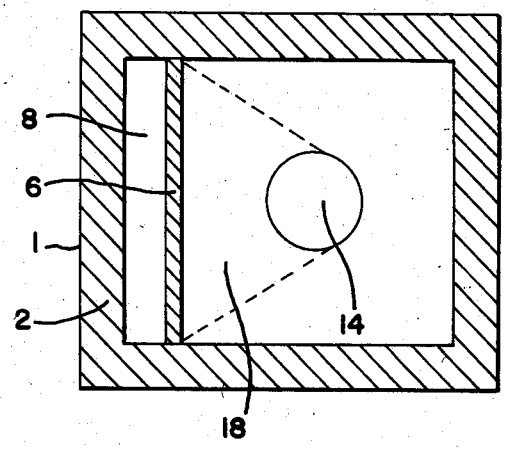

The invention will be better appreciated by reference to the accompanying sheet of drawings in which:

FIG. 1 shows a view in vertical section along a longitudinal central plane of a ladle according to the invention, and FIG. 2 shows a view in horizontal section taken along line X'X in FIG. 1.

Referring to FIG. 1, shown therein is an external metal casing 1, an internal refractory lining 2, an intake spout or channel 3 for the metal to be treated at 5, an outlet spout or channel 4, an internal vertical partition 6 which, with the bottom of the ladle, leaves a space 7 for the flow of the metal and which divides the ladle into a feed compartment 8 and a treatment compartment 9 in which is disposed a rotor 10 which is driven with a rotary movement by the shaft 11 connected to a motor (not shown) disposed above the cover 12. The compartment 9 is closed at its base by a horizontal wall 13 which extends at the level of the bottom of the partition and which at its centre is apertured with an opening 14, the axis of which coincides with the axis of the rotor.

In operation, the metal passes through the opening 14 along the paths of movement indicated at 15 in co-flow relationship with the paths of flow of gas 16 which is emitted radially by the rotor.

Under the action of the chlorinated gas, the magnesium reacts to form liquid magnesium chloride which is accumulated at the surface of the metal bath in a molten state to form a layer 17 while the purified metal flows away through the outlet spout 4.

Referring to FIG. 2 which is a view of the ladle in section taken along line X'X in FIG. 1, shown therein is the external metal casing 1, the internal refractory lining 2, the feed compartment 8, the vertical partition 6 and the outline of the duct or passage 18 for the flow of metal towards the opening 14.

The invention will be better appreciated by reference to the following example of use thereof:

A ladle with a useful height of 1 meter, having a feed compartment with useful dimensions of 1 m×0.15 m and a treatment compartment of useful dimensions of 1 m×1 m, provided with an intake spout and an outlet spout which make it possible to operate with a height of metal of 0.80 m, was fitted with a horizontal wall spaced from the bottom at 0.05 m and provided with a central circular opening 0.32 m in diameter. A rotor of 0.32 m in diameter and 0.275 m in height, provided with 136 holes of 0.0015 m in diameter and rotating at a speed of 250 rpm was disposed at a distance of 0.03 m from the wall and on the axis of the opening.

The ladle was continuously fed with aluminium alloy at a suitable temperature to maintain it at from 750° to 800° C. in the treatment compartment, and with pure chlorine.

Depending on the flow rates used and the initial magnesium content, the results obtained as regards the final magnesium content, the chlorine flow rate and the level of efficiency are as follows:

| | Example 1 | Example 2 | Example 3 | Example 4 |
|---|---|---|---|---|
| Metal flow rate | 10 t/h | 20 t/h | 10 t/h | 20 t/h |
| Magnesium content before the ladle | 0.71% | 0.45% | 0.40% | 0.29% |
| Magnesium content after the ladle | 0.15% | 0.15% | 0.09% | 0.08% |
| Chlorine flow rate | 165 kg/h | 175 kg/h | 100 kg/h | 150 kg/h |
| Efficiency ($Cl_2$ combined in the form of $MgCl_2$) | ~100% | ~100% | ~90% | ~80% |

It is found therefore that, with a ladle of a capacity of close to 1 $m^3$, it is possible to attain treatment capacities of the order of 20 tonnes per hour with a suitable level of efficiency in regard to removal of magnesium.

We claim:

1. A ladle for the chlorination of molten aluminum alloys to remove magnesium, comprising a feed compartment having an intake spout, a treatment compartment having an outlet spout, a vertical partition separating said feed compartment from said treatment compartment, said vertical partition positioned at a distance above the bottom of the ladle to form a space for the flow of molten metal, a horizontal wall having an opening therethrough and extending at the level of the bottom of said vertical partition to close said treatment compartment at its base, and a rotor disposed within said treatment compartment for radial dispersion of chlorinated gas, the axis of said rotor coinciding with the axis of said opening, whereby molten aluminum passing through the opening flows in the same direction as the gas dispersed by the rotor.

2. A ladle according to claim 1 characterised in that the ladle has a useful capacity which is at most equal to 1 $m^3$.

3. A ladle according to claim 1 characterised in that the section of the opening is between 1/10 and 1/15 of the section of the treatment compartment.

4. A ladle according to claim 1 characterized in that the flow of the metal from the bottom of the partition towards the opening is along a duct which initially, at the location of the partition, is of a width in a horizontal plane which is close to the width of the partition and which then progressively reduces so that close to the opening it reaches a width corresponding to the largest dimension of the opening.

5. A ladle according to claim 1 characterised in that the rotor has a horizontal section of dimensions which are close to those of the opening.

6. A ladle according to claim 1 characterised in that the rotor has ducts for the distribution of chlorinated gas, of a section sufficient to produce a flow rate that attains 240 kg/hour.

7. A ladle as in claim 1, wherein gas outlet openings of said rotor are located closely adjacent said opening.

* * * * *